US009669278B1

(12) United States Patent
Brown

(10) Patent No.: US 9,669,278 B1
(45) Date of Patent: Jun. 6, 2017

(54) EXERCISE BENCH AND ATTACHMENTS

(71) Applicant: Larry Justin Brown, Adair, OK (US)

(72) Inventor: Larry Justin Brown, Adair, OK (US)

( * ) Notice: Subject to any disclaimer, the term of this patent is extended or adjusted under 35 U.S.C. 154(b) by 199 days.

(21) Appl. No.: 13/868,393

(22) Filed: Apr. 23, 2013

Related U.S. Application Data

(60) Provisional application No. 61/687,500, filed on Apr. 26, 2012.

(51) Int. Cl.
*A63B 69/34* (2006.01)
*A63B 26/00* (2006.01)
*A63B 69/00* (2006.01)

(52) U.S. Cl.
CPC ..... *A63B 69/004* (2013.01)

(58) Field of Classification Search
CPC ..... A63B 69/004; A63B 69/20; A63B 23/02; A63B 23/0205; A63B 23/0211; A63B 23/02114
USPC ..... 482/140, 142, 145, 83
See application file for complete search history.

(56) References Cited

U.S. PATENT DOCUMENTS 5,135,458 A * 8/1992 Huang ..... A63B 22/02 482/138
5,702,334 A * 12/1997 Lee ..... A63B 23/0227 482/131
6,264,586 B1 * 7/2001 Webber ..... A63B 21/078 482/104
6,387,024 B1 * 5/2002 Monti ..... A63B 21/00072 482/130
6,932,749 B2 * 8/2005 Barnes ..... A63B 21/00072 482/130
7,322,911 B2 * 1/2008 Webber ..... A63B 23/02 482/142
7,381,171 B2 * 6/2008 Chen ..... A63B 21/045 482/140
7,530,936 B1 * 5/2009 Hall ..... A63B 21/0615 482/137
7,708,675 B2 * 5/2010 Miskech ..... A63B 21/00181 482/140
7,731,639 B1 * 6/2010 Shifferaw ..... A63B 21/00181 482/108
8,033,963 B1 * 10/2011 Jones ..... A63B 21/154 482/100
D664,615 S * 7/2012 Chuang ..... D21/687
2007/0032357 A1 * 2/2007 Piane ..... A63B 1/00 482/142
2009/0209397 A1 * 8/2009 Miskech ..... A63B 21/00181 482/140
2010/0048368 A1 * 2/2010 Donofrio ..... A63B 1/00 482/130

(Continued)

*Primary Examiner* — Stephen Crow
*Assistant Examiner* — Garrett Atkinson
(74) *Attorney, Agent, or Firm* — Crowe & Dunlevy, P.C.

(57) ABSTRACT

An adjustable declined exercise bench and adjustable punching or striking attachments for the exercise bench that attach to the upper end of the bench. The bench is segmented into an upper stationary end segment and a lower pivotable end segment. The lower end segment of the bench where the user's back or will rest can swivel with the movement of the user's torso. Movement of the lower segment of the bench is in opposition to a resistance band that keeps the lower segment under tension and tends to hold the lower segment in an aligned position relative to the upper segment of the bench.

12 Claims, 4 Drawing Sheets

(56) References Cited

U.S. PATENT DOCUMENTS

| | | | | |
|---|---|---|---|---|
| 2010/0227742 | A1* | 9/2010 | Jutte | A63B 21/16<br>482/87 |
| 2010/0227743 | A1* | 9/2010 | Jutte | A63B 21/16<br>482/87 |

* cited by examiner

EXERCISE BENCH AND ATTACHMENTS

CROSS-REFERENCE TO RELATED APPLICATIONS

The present application claims priority to U.S. Provisional Patent Application No. 61/687,500 filed on Apr. 26, 2012 for the invention entitled "Crunch Punch—An Upper Body Workout Device That Works Strength+Conditioning, Cardio, Technique, Reflexes, etc.".

BACKGROUND OF THE INVENTION

1. Field of the Invention

The present invention relates to an adjustable declined exercise bench having adjustable punching attachments attached to an upper end of the exercise bench. Also, the bench itself may be segmented into an upper stationary end segment and a lower pivotable end segment. The lower end segment is capable of moving against resistance in conjunction with movement of the user's back which rests thereon.

2. Description of the Related Art

Declined exercise benches are employed to allow a user to do crunches and other exercises with increased effect due to the fact that the user's head is located at a lower end of the bench and the user must use their core muscles to raise their torso upward against the pull of gravity in order to perform the exercises. Declined exercise benches can be rather boring to use, and they do not lend themselves to a total body workout.

Also, when a user is training to fight or box, it would be desirable to be able to employ the declined exercise bench to teach the user fighting techniques or boxing moves while the user was laying on the bench with their back and spine properly supported.

The present invention addresses these needs. The purpose of the present invention is to improve overall core, upper body strength and agility. The present invention also helps the user to learn fighting techniques while getting a total body workout. The invention is provided with a segmented bench with a lower swiveling segment or backrest that swivels with resistance to work various muscles. This allows the user to lie on the bench and work core muscles, taking pressure off of the spine.

The present invention is a solid design that facilitates more aggressive workouts for the serious athlete. Each attachment is fully adjustable to the individual and can be provided with different levels of resistance. The segmented bench can also be provided with different levels of resistance. The present invention can be used with numerous workouts for muscle confusion and also breaking up the monotony for everyday core workout.

SUMMARY OF THE INVENTION

The present invention relates to an exercise bench and adjustable attachments for the exercise bench. More specifically, the present invention is an adjustable declined exercise bench to which a punching or striking attachment is added on the upper end of the bench. The punching attachment is adjustable to fit all sizes of users and may be of either a fixed or moveably design. Also, the bench itself may be segmented into an upper end segment and a lower end segment.

The upper end segment where the user's lower body will rest when the bench is in use is preferably stationary. The lower end segment of the bench where the user's back or will rest when the bench is in use is pivotable so that it can swivel with the movement of the user's torso. Movement of the lower segment of the bench is in opposition to a resistance band that keeps the lower segment under tension and tends to hold the lower segment in an aligned position relative to the upper segment of the bench.

DETAILED DESCRIPTION OF THE PREFERRED EMBODIMENT

Figure 1:
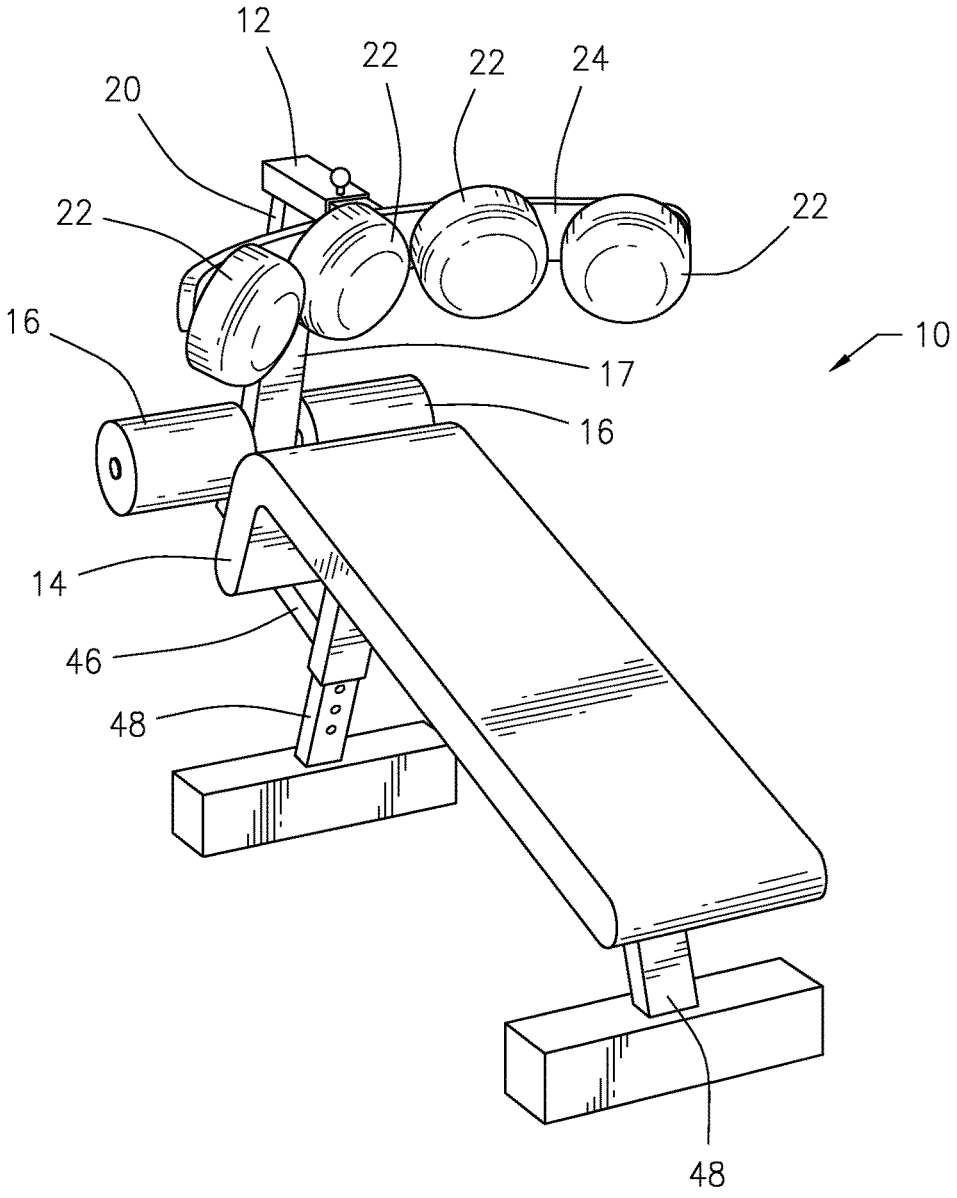
FIG. 1 is right frontal prospective view taken of a first embodiment of an exercise bench that is constructed in accordance with a first preferred embodiment of the invention.
Figure 2:
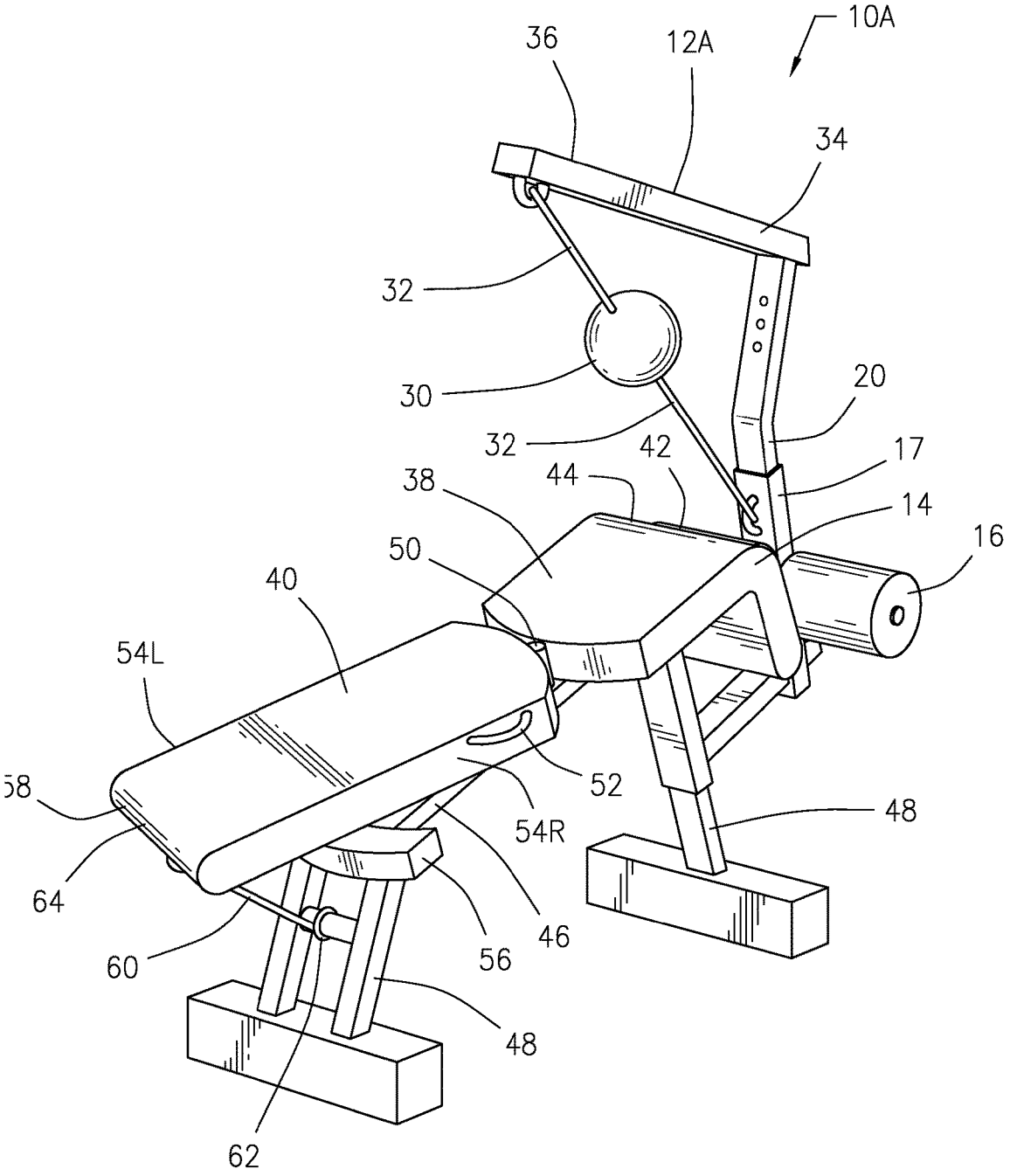
FIG. 2 is left frontal prospective view taken of a second embodiment of an exercise bench that is constructed in accordance with a second preferred embodiment of the invention.
Figure 4:
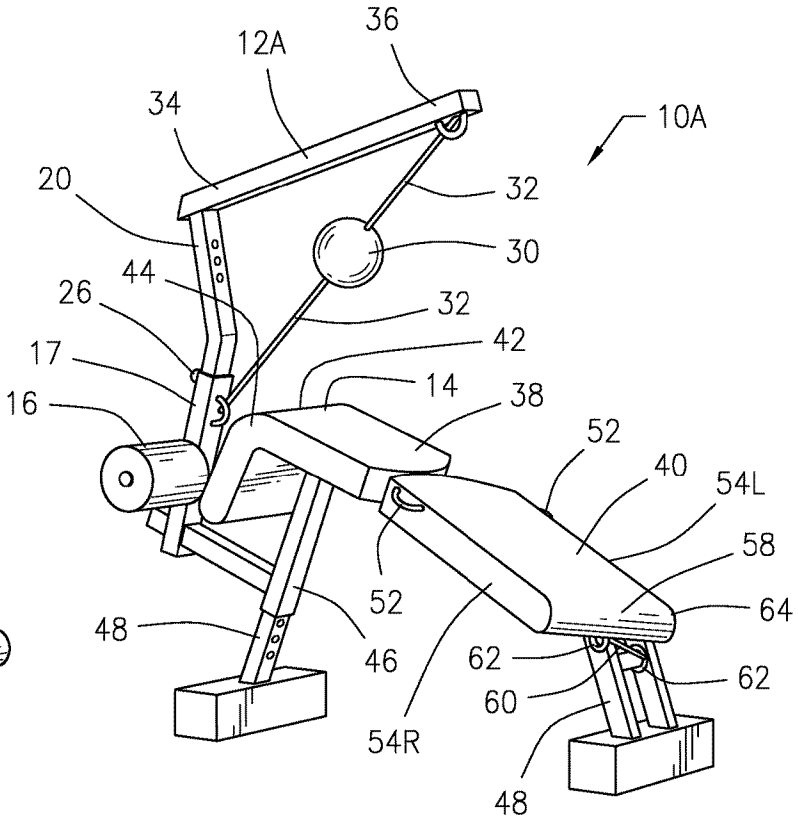
FIG. 4 is a right frontal prospective view of the exercise bench of FIG. 2.
Figure 3:
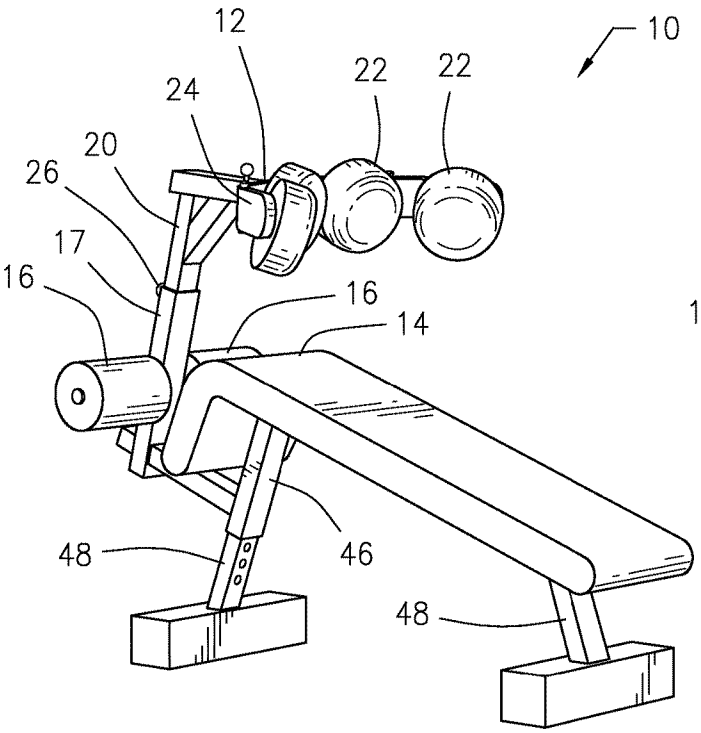
FIG. 3 is another right frontal prospective view of the exercise bench of FIG. 1.
Figure 6:
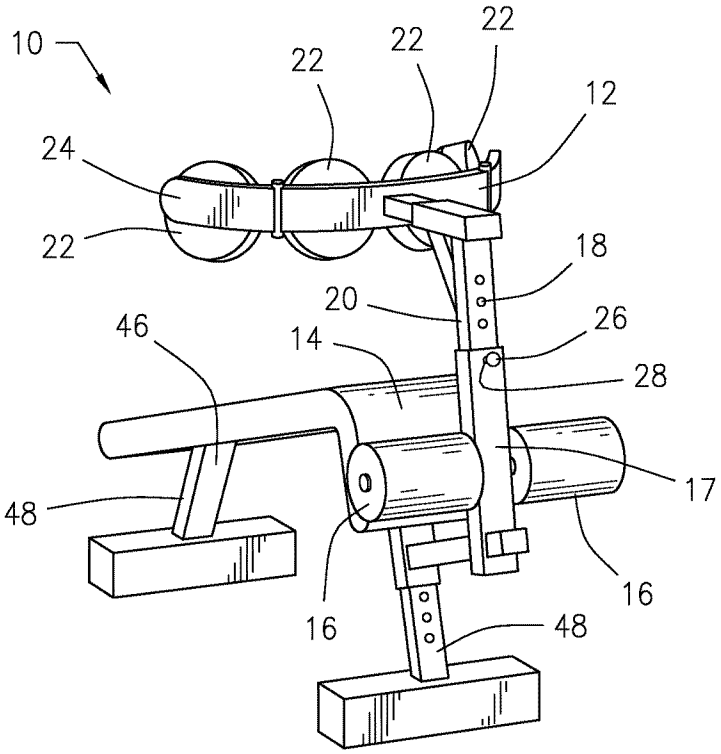
FIG. 6 is left rear prospective view of the exercise bench of FIGS. 2 and 4.
Figure 5:
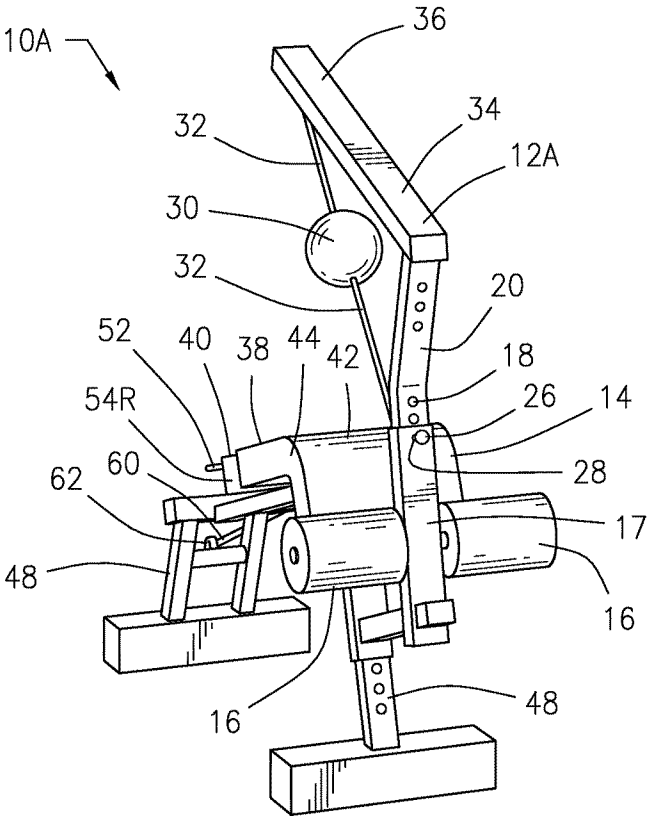
FIG. 5 is left rear prospective view of the exercise bench of FIGS. 1 and 3.

Referring now to the drawings and initially to FIGS. 1, 3 and 5, there is illustrated a first preferred embodiment of the present invention 10. FIGS. 2, 4, and 6 illustrate a second preferred embodiment of the invention 10A. The invention is an adjustable declined exercise bench 10 or 10A that is provided with and adjustable punching or striking attachment 12 or 12A. The attachment 12 or 12A is attached on the upper or rear end 14 of the bench 10 or 10A. The attachments 12 or 12A secure to the bench 10 or 10A via an assembly attachment sleeve 17 provided on the upper or rear end 14 of the bench 10 or 10A. The exercise bench 10 or 10A is also provided with leg supports 16 that are located on the upper or rear end 14 of the bench 10 or 10A.

Each punching attachment 12 or 12A is adjustable in height by means of various adjustment holes 18 provided on the assembly support arm 20 in order to fit all sizes of users and may be of either a fixed design such as attachment 12 or a moveably design such as attachment 12A. The fixed design 12 is illustrated in FIGS. 1, 3, and 5 whereas the movable design 12A is illustrated in FIGS. 2, 4, and 6.

The fixed design 12 has several padded striking mitts 22 that are secured to a generally horizontal support member 24 which in turn is secured to a generally vertical assembly support arm 20. The assembly support arm 20 is received in the assembly attachment sleeve 17 and is secured therein with a removable pin 26 that inserts into a hole 28 provided on the assembly attachment sleeve 17 and one of the adjustment holes 18 provided in the assembly support arm 20.

The movable design 12A is a single punching ball 30 that is suspended via flexible elastic strips 32 between a supporting punching ball assembly support 34 and the pin 26 that secures the punching ball assembly support 34 within the assembly attachment sleeve 17. The punching ball assembly support 34 is v-shaped with one leg being an upper support arm 36 and the other leg being a lower assembly support arm 20. The upper support arm 36 extends forward at an angle above the bench 10 or 10A and the lower assembly support arm 20 inserts into the assembly attachment sleeve 17 to hold the punching ball 30 suspended in the air above the bench 10 or 10A and away from the punching ball assembly support 34.

Also, as illustrated in FIGS. 2, 4, and 6 the bench 10A itself may be made in two segments: an upper end segment 38 and a lower end segment 40. Both segments 38 and 40 are padded for the user's comfort, and the upper end segment 38 is preferably L-shaped with the rear end 42 of that segment 38 turned downward so that a user's legs can comfortable curl around the bend 44 in the upper end segment 38 when lying on the bench 10 or 10A.

The upper end segment 38, i.e. the rear segment where the user's lower body will rest when the bench 10A is in use, is preferably stationary relative to the frame 46 and supporting legs 48 for the bench 10A. The lower end segment 40, i.e. the front segment of the bench 10A where the user's back will rest when the bench 10A is in use, is pivotable so that it can swivel with the movement of the user's torso. The bearing 50 by which the lower end segment 40 attaches to the frame 46 of the bench 10A is provided between the upper end segment 38 and the lower end segment 40.

The lower end segment 40 is provide with handles 52 on either side 54L and 54R of the segment 40 to provide a means for the user to hold onto the bench 10A to help stabilize the user on the bench 10A and to allow the user to move the lower end segment 40 in a side to side pivoting or swiveling fashion.

The frame 46 of the bench 10A is provided with a track 56 on which the front end 58 of the lower end segment 40 rides and is supported as it pivots side to side.

Movement of the lower end segment 40 of the bench 10A is in opposition to a resistance band 60 that keeps the lower end segment 40 under tension and tends to hold the lower end segment 40 in an aligned position relative to the upper end segment 38 of the bench 10A. The resistance band 60 attaches to resistance band hooks 62 provided on the front end 58 of the lower end segment 40 and to a leg 48 of the bench 10A provided on the front end 64 of the bench 10A. The resistance band 60 can be selected to provide the desired resistance to movement from side to side of the lower end segment 40.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. An adjustable inclined exercise bench, comprising:
an inclined bench seat for a user to lay upon,
a plurality of leg supports provided on an upper end of the exercise bench,
a striking attachment comprising an arcuate, generally horizontal support member removably secured to the upper end of the exercise bench, and
a plurality of padded striking mitts attached to said support member of said striking attachment.

2. The adjustable inclined exercise bench according to claim 1 wherein said striking attachment further comprises
a generally vertical assembly support arm attached to said generally horizontal support member; said assembly support arm removably secured an assembly attachment sleeve provided on the upper end of the exercise bench.

3. The adjustable inclined exercise bench according to claim 2 further comprising:
a removable pin removably inserted into a hole in the assembly attachment sleeve and into one of various adjustment holes provided in the assembly support arm.

4. The adjustable inclined exercise bench according to claim 1 wherein each of said padded striking mitts comprises a generally vertical striking face oriented toward said inclined bench seat.

5. The adjustable inclined exercise bench according to claim 4 wherein said padded striking mitts are positioned above said leg supports provided on said upper end of said exercise bench.

6. The adjustable inclined exercise bench according to claim 1 wherein said arcuate, generally horizontal support member is curved toward said inclined bench seat along the horizontal plane.

7. An adjustable inclined exercise bench, comprising:
an inclined bench seat attached to a bench frame;
a plurality of leg supports attached to said bench frame;
a striking attachment assembly removably securable to said bench frame, said striking attachment assembly comprising:
a generally vertical assembly support arm attached to a generally horizontal, arcuate support member, said assembly support arm removably securable to said bench frame;
a plurality of padded striking mitts attached to said arcuate support member, each of said padded striking mitts comprising a generally vertical striking face.

8. The exercise bench of claim 7 wherein said assembly support arm is removably secured an assembly attachment sleeve of said bench frame.

9. The exercise bench of claim 8 further comprising a removable pin removably insertable into a hole in the assembly attachment sleeve and into one of various adjustment holes provided in the assembly support arm.

10. The exercise bench of claim 7 wherein said padded striking mitts are positioned above said leg supports provided on said upper end of said exercise bench.

11. The exercise bench of claim 7 wherein said arcuate support member is curved toward said inclined bench seat along the horizontal plane.

12. The exercise bench of claim 7 wherein said generally vertical striking faces of said padded striking mitts are oriented toward said inclined bench seat.

* * * * *